United States Patent [19]

Basnett

[11] Patent Number: 4,479,042

[45] Date of Patent: Oct. 23, 1984

[54] CONTACT OVERTRAVEL ADJUSTMENT APPARATUS FOR A VACUUM CONTACTOR

[75] Inventor: Robert T. Basnett, Hendersonville, N.C.

[73] Assignee: Westinghouse Electric Corp., Pittsburgh, Pa.

[21] Appl. No.: 486,589

[22] Filed: Apr. 19, 1983

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 2,981,817 | 4/1961 | Frentzel | 200/144 B |
| 3,267,247 | 8/1966 | Ross | 200/144 B |
| 3,582,587 | 6/1971 | Barkan | 200/144 B |

FOREIGN PATENT DOCUMENTS

| | | | |
|---|---|---|---|
| 355535 | 8/1931 | United Kingdom | 200/144 B |

*Primary Examiner*—Robert S. Macon

*Attorney, Agent, or Firm*—John Victor Pezder

[57] ABSTRACT

Contact overtravel adjustment apparatus for a vacuum contactor. Two nuts, each having a plurality of radially spaced teeth about their periphery, are threaded onto the mounting stud or shaft of the moveable contact of each vacuum interrupter in the contactor. The first nut is positioned on the shaft to establish the contact overtravel gap. The second nut is used to lock the position of the first nut. A blade of a screwdriver is inserted between adjacent teeth in both nuts. Rotation of the screwdriver in one direction locks the two nuts while the rotation thereof in the opposite direction loosens the two nuts. The teeth allow the torque used for tightening to be applied to the nut with zero net torque being applied to the shaft of the moveable contact of the vacuum interrupter. The toothed nuts also provide for a more accurate setting of the overtravel gap adjustment.

10 Claims, 6 Drawing Figures

CONTACT OVERTRAVEL ADJUSTMENT APPARATUS FOR A VACUUM CONTACTOR

CROSS-REFERENCE TO RELATED APPLICATIONS

The material presented herein is related the material presented in the following copending patent applications: Ser. No. 486,584, filed Apr. 19, 1983, entitled "Vacuum Contactor Having DC Electromagnet with Improved Force Watts Ratio;" Ser. No. 486,590, filed Apr. 19, 1983, entitled "Vacuum Contactor Kickout Spring Adjustment Apparatus;" Ser. No. 486,588, filed Apr. 19, 1983, entitled "Mechanical Interlock Mechanism for a Vacuum Contactor."

BACKGROUND OF THE INVENTION

1. Field of the Invention

In general, the invention relates to vacuum contactors emloying vacuum interrupters and in particular to the means used to provide for the overtravel of the contacts caused by the wear thereof during the normal operations of the vacuum contactor.

2. Description of the Prior Art

There are many designs of vacuum interrupters in existence. U.S. Pat. No. 4,002,867, issued Jan. 11, 1977 entitled "Vacuum Type Circuit Interrupters With a Condensing Shield at a Fixed Potential Relative to the Contact" is a representative example of such vacuum interrupters. An operating mechanism combined with one, two or three vacuum interrupters constitutes a vacuum contactor. In contradistinction to circuit breakers which are considered as principal protective devices during fault conditions in an electrical circuit and are designed for 20,000 to 50,000 operations, the vacuum contactor is used to start and stop various electric loads in response to signals generated by control devices such as push button switches, limit switches, and programmable controllers with the vacuum contactor being designed to have a lifetime of 2 to 3 million operations.

The main difference between vacuum contactors and conventional air break contactors is that the vacuum interrupters of the vacuum contactor break or interrupt the electric current inside a vacuum chamber instead of inside an air arc box. The vacuum chamber for the vacuum interrupter consists of a unit assembly of a sealed evacuated enclosure surrounding a fixed or stationary electrical contact and a moveable electrical contact. A portion of the moveable contact extends through a gas-tight metallic bellows which allows for the essentially linear motion of the moveable contact with respect to the stationary contact. The bellows is attached to the evacuated chamber by means of an end seal. Another end seal is provided for attaching the stationary contact to the enclosure. A ceramic sleeve or cylinder is provided to separate and electrically isolate the two contacts. The end seals are attached to the ends of the ceramic sleeve forming the evacuated chamber of the vacuum interrupter.

Because vacuum interrupters are normally closed by atmospheric pressure and an auxiliary contact spring, means must be provided to force the contacts into the open position which is the normal state for a deenergized contactor. The actual contact force holding the moveable and stationary contacts together inside each vacuum interrupter is the sum of the atmospheric force (atmospheric pressure times the mean area of the bellows) plus the force provided by the auxiliary contact spring and the mechanical spring force of the bellows. This auxiliary contact spring force increases the total force sufficiently to sustain closure of the contacts during high short circuit currents that tend to blow the contacts apart. In the deenergized condition, there is no electrical energy available to provide the force necessary to separate the contacts. Instead, one or more mechanical springs provide this contact opening force. In practice this spring, called the kickout spring, exerts sufficient force to maintain the contacts in the open position in a deenergized contactor. To close the contacts of the vacuum interrupter on command, an electromagnet is provided that when energized, will pull the operating mechanism closed, overcoming the force of the kickout spring and closing the contacts of the vacuum interrupter.

One inherent problem with typical vacuum contactors is the short travel of the vacuum contacts, for example, only 0.150 to 0.200 inches. This small travel is favorable for obtaining a high pulling force from the electromagnet, but causes difficulties in setting devices used to indicate contact wear. For a vacuum interrupter, the contact wear allowance or contact overtravel per pair of contacts in the interrupter may be 0.125 inches down to a minimum of only 0.020 inches, the measurement of which requires a feeler gauge rather than a mechanic's scale. The problem cannot be solved by increasing the travel of the moving contacts beyond 0.200 inches because the mechanical life of the metallic bellows decreases rapidly as the amount of contact travel increases. Furthermore, the actual contact faces inside the vacuum chamber cannot be observed directly, so this small measurement must be made on a secondary reference, usually an arm in the operating mechanism of the contactor through which a portion of the shaft of moveable contact extends.

One means presently used to set contact overtravel is a double nut arrangement. With the contacts closed, a large diameter hex nut is threaded onto the extended portion or shaft of the moveable contact that extends beyond the arm of the operating mechanism. By turning the large nut on the shaft of the moveable contact, an overtravel gap between a surface of the nut and the arm can be established. A second smaller diameter hex nut is then threaded onto the shaft to lock the first hex nut in place. Accuracy in this overtravel setting is important in that too small of a gap leads to premature replacement of the interrupter while too large of a setting can indicate that there is additional contact material remaining when in fact the contacts have actually eroded to the point of replacement. This latter condition can result in faulty closing or arcing in the contactor.

In most vacuum contactor designs space within which adjustments can be made is usually at a premium. In order to set the overtravel gap, the first hex nut must be restrained from turning while the second hex nut is tightened against it. Usually ribs on the arm or electrical barriers in the housing limit the angular travel of a common wrench and prevent the insertion of an adjustable wrench into the space available. With the hexagonal nuts and limited wrench clearance, an accurate setting of the overtravel gap is difficult to make. For example, if the threaded shaft of the contact has 18 threads to the inch then one turn amounts to a linear travel of 55 thousandths and one sixth turn (to accommodate the hex shape of the nut) can amount to 9 thousandths. If the desired setpoint is 120 thousandths (0.120), 9 thousandths represents 7.5% of the setpoint value. In addition, due to the fact that wrenches have finite widths for their bodies, the full angle for holding the first hex nut may not be possible leading to a setting discrepancy beyond 9 thousandths. Thus, a nut which can be locked in place without the use of a wrench allowing for a more accurate setting of the overtravel gap would be desirable.

Another problem encountered with the use of the hex nuts is the transmission of torque to the shaft of the moveable contact during tightening of the nuts. With some vacuum interrupters, application of torque to the moveable contact can damage the bellows or insulating seal of the interrupter leading to premature failure. Accordingly, nuts which can be tightened without transferring torque to the shaft of the contact would also be desirable.

SUMMARY OF THE INVENTION

In general, the invention relates to a combination of a vacuum contactor emloying a double nut arrangement to provide an overtravel gap setting for the contacts thereof. The vacuum contactor is one or more vacuum interrupters, each having a stationary contact and a moveable contact, in combination with an operating mechanism which is connected to the moveable contact of each of the interrupters that are present. The operating mechanism opens and closes the vacuum interrupter or interrupters in response to a control signal. Included in the operating mechansim are a spring and an electromagnet which are mecahnically linked to the moveable contacts of the vacuum interrupters and are used to provide the forces necessary to open and close, respectively, the contacts of the interrupters. The contacts are enclosed in an evacuated chamber having a substantially gas-tight opening through which a thread shaft portion of the moveable contact extends. A housing is provided for supporting the shaft, the operating mechansim, and the vacuum interrupter or interrupters.

Adjacent the threaded shaft of the moveable contact is an arm of the operating mechanism used to effect the transfer of the moveable contact. An opening through which the threaded shaft passes is provided in the arm. The arm and shaft are linked by the use of two nuts which also serve as the means for setting the contact overtravel. A first nut and a second nut, each having a threaded bore therethrough and a plurality of radially spaced teeth about the periphery thereof, are turned onto a portion of the threaded shaft of the moveable contact that extends beyond the arm of the operating means. The arm contacts the first nut to hold the moveable contact in the open position. When the moveable contact is in the closed position, the first nut is spaced from the arm a distance representing the overtravel gap for the vacuum interrupter. Once the overtravel gap is set with the first nut, the second nut is threaded onto the shaft until it contacts the first nut. Rotation of the blade of a screwdriver inserted between two teeth of the first nut and two teeth of the second nut locks the two nuts at the desired location. The screwdriver engages diagonally opposite teeth in the first and second nuts rotating the two nuts in opposite directions with respect to one another. The rotation of the blade in one direction tightens the first and second nuts with rotation of the blade in the opposite direction loosening them. The teeth of the first and second nuts permit the nuts to be removably secured to the shaft of the moveable contact without the transmission of torque to the shaft itself.

A spacing washer can be interposed with the first nut and the second nut separating the first nut and the second nut on the shaft of the moveable contact. This allows the rotation of the blade of the screwdriver to exert greater force upon the first nut and the second nut. The teeth of the two nuts allow the torque used for tightening to be applied in an axis which is perpendicular to that of the shaft of the moveable contact.

BRIEF DESCRIPTION OF THE DRAWINGS

For a better understanding of the invention, reference may be made to the preferred embodiments exemplary of the invention shown in the accompanying drawings, wherein.

DESCRIPTION OF THE PREFERRED EMBODIMENTS

Figure 1:
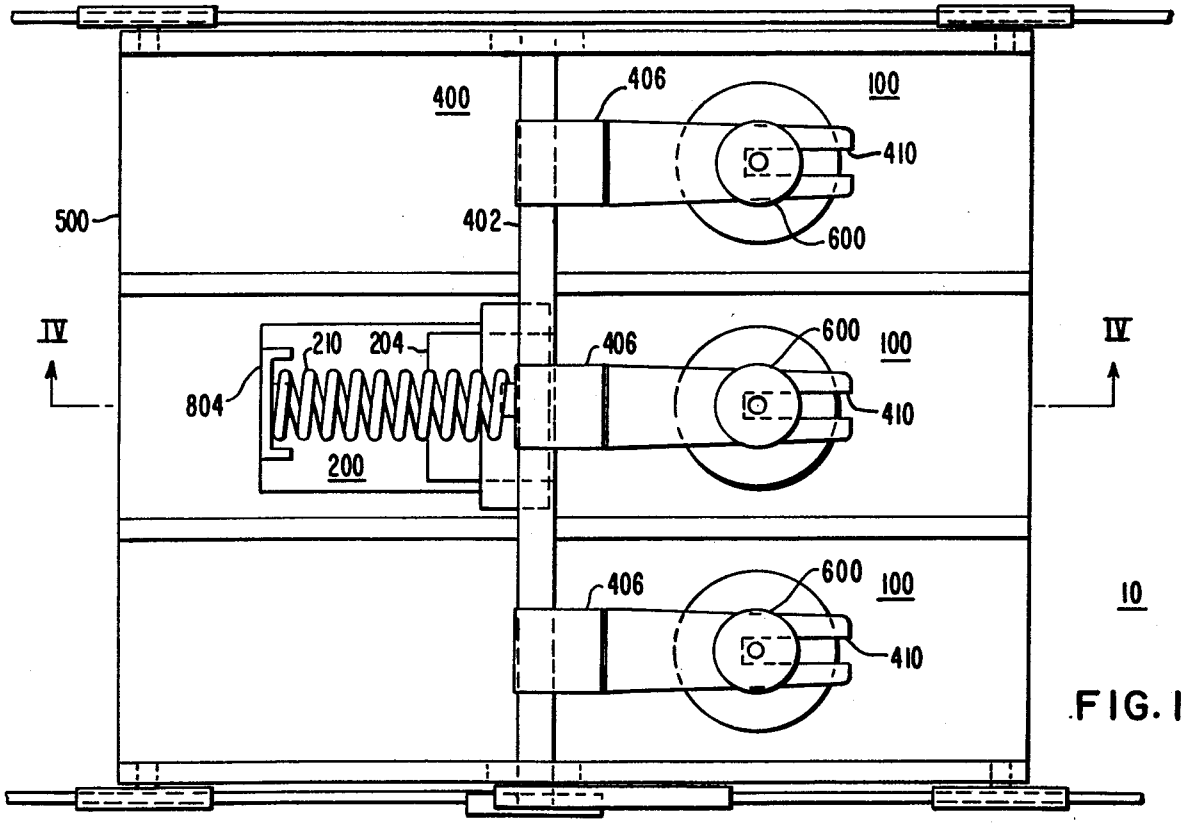
FIG. 1 is a plan view of a vacuum contactor embodying the present invention.

Referring to FIGS. 1 through 5, a vacuum contactor 10 comprising a vacuum interrupter 100, an operating mechanism 200 for the interrupter 100 including a linkage 400 and a contact overtravel adjustment apparatus 600 is shown. The interrupter 100 includes a stationary contact 102, a moveable contact 104, and an electrically insulating sleeve 105 and two end seals **106*a* and 106*b* forming an evacuated chamber 107 enclosing both contacts. An opening is provided in the chamber 107 through which a shaft extension 108 of the moveable contact 104 passes. The combination of a metallic bellows 110 and the end insulating seal 106*a* provides a gas-tight seal for the opening of the chamber 107 while allowing for the linear motion of the moveable contact 104. The stationary contact 102 mounts to the sleeve 105 via the end seal 106*b* and connects to an electrically conductive bus 114 via a fastener such as the bolt 116. A flexible electrically conductive shunt 118 is provided between a second bus bar 120 and the shaft extension 108 of the moveable contact 104 thus completing the other side of the circuit. When the contacts are closed, the electric circuit through the second bus bar 120, shunt 118, moveable contact 104, stationary contact 102, and first bus bar 114 is complete. The insulating sleeve 105, usually made of a ceramic material, is necessary in order to maintain the electrical isolation of the moveable contact 104 from the stationary contact 102 when the vacuum interrupter 100 is deenergized in that the stationary contact 102** is usually connected to the source of electrical potential.

The operating mechanism 200 includes an electromagnet 202 that when energized closes the contacts and a kickout spring 210 that opens the contacts when the electromagnet 202 is deenergized. The electromagnet 202 is a two-piece assembly with a magnetically permeable, U-shaped core 204 and a dual winding assembly 206 having pickup and holding coils (not shown) being disposed about the legs of the core 204. Because of space considerations, the operating mechanism is not axially aligned with the moveable contact 104. Accordingly, a linkage 400 is used between the operating mechanism 200 and the moveable contact 104 to translate the opening and closing forces to the axis of movement of the moveable contact 104. The linkage 400 consists of a shaft 402 that has a radially extending leg 404 and arm 406 and is rotatably supported by means of bearings 408 provided in the housing 500. One arm is provided for each vacuum interrupter in the contactor. The majority of applications require a contactor having 3 poles leading to the use of 3 vacuum interrupters and 3 arms as shown in FIG. 1. However, contactors having other numbers of interrupters can also be constructed.

The leg 404 extends from the shaft 402 adjacent the core 204 of the electromagnet 202, the portion of the leg 404 adjacent the core 204 being magnetically permeable. The arm 406 extends from the shaft 402 to the shaft extension 108 of the moveable contact 104. An opening 410 is provided in the arm 406 to allow the shaft extension 108 to pass therethrough. The size of the opening 410 permits a small degree of misalignment with respect to the shaft extension 108. The opening 410 can be either circular or slotted as shown. The slotted opening facilitates removal of the vacuum interrupter 100 when necessary. The portion of the shaft extension 108 projecting beyond the arm 406 is threaded allowing contact overtravel apparatus 600 to be fastened thereto preventing the withdrawal of the shaft extension 108 from the arm 406.

The contact overtravel adjustment apparatus 600 includes a first nut 602 and a second nut 604, each having threaded bores therethrough and a plurality of radially spaced teeth 608 about the periphery thereof. In order to establish the overtravel gap g the contactor is closed with the first nut 602 being threaded onto the shaft 108 and spaced a distance away from a pivot plate 412, described hereinafter, provided on the arm 406. Where no pivot plate is provided, the overtravel gap g is measured with respect to the arm 406. Preferably the overtravel gap is measured with respect to the surface 610 of the nut 602 proximate the arm 406; however the distal surface 612 of the nut 602 can also be used. Whichever surface is used must be used consistently as the reference in order to avoid errors in the measurement.

Once the overtravel gap g is established, the second nut 604 is threaded onto the shaft extension 108 of the moveable contact until contact with the first nut 602 is made. At this point the blade 900 of a screwdriver is inserted into the space between two adjacent teeth of both the first nut 602 and the second nut 604. The blade 900 is then rotated causing the first nut 602 and the second nut 604 to rotate in opposite directions with respect to each other. Rotation of the blade 900 in one direction will lock the nuts in position while the rotation thereof in the opposite direction will loosen them. With the plurality of teeth 608, there is no difficulty in locking the first nut 602 at any position desired.

One or more spacing washers 606 can be positioned intermediate the two nuts 602 and 604 providing a small separation therebetween. This moves the teeth 608 of the two nuts closer to the side edges of the blade 900 away from the centerline of rotation thereof. This increases the distance that the blade 900 can turn allowing for more torque to be applied to the two nuts 602 and 604.

Figure 3:
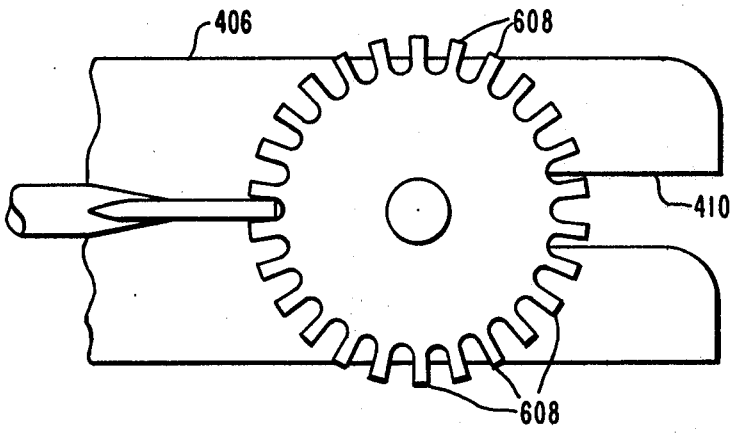
FIG. 3 is a plan view of the apparatus shown in FIG. 2.
Figure 2:
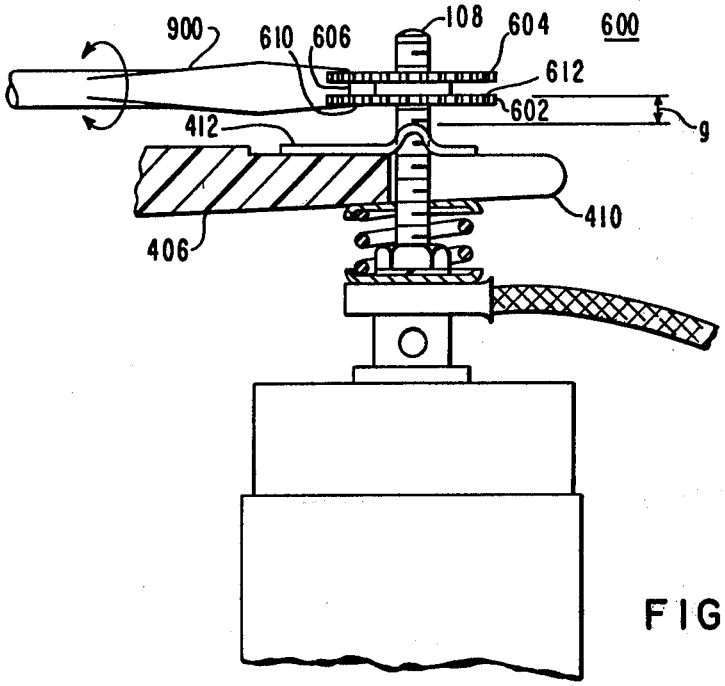
FIG. 2 is a detail of the connection of a vacuum interrupter of FIG. 1 to an arm of the operating mechanism showing the adjustment of the nuts used to set the overtravel gap.

As can be seen in FIGS. 2 and 3, the torque of the screwdriver is transmitted to the teeth of the nuts along a line substantially perpendicular to the shaft extension 108 locking the nuts 602 and 604 with zero net torque. With hex nuts the torque is applied about the axis of the shaft extension tending to twist the shaft and bellows connected thereto. Preferably, both of the nuts have substantially the same diameter with the teeth of the nuts lying in a plane generally perpendicular to the axis of the threaded bore therein. Other configurations for the teeth are possible. One such configuration would be where the teeth are perpendicular to the plane defined by the nut and look like a parapet of a castle. With this configuration the two nuts would be positioned with the teeth in opposition.

The contact overtravel adjustment mechanism eliminates the need to use two wrenches to lock in the overtravel gap adjustment for each vacuum interrupter and substitutes a simple screwdriver adjustment. The contact overtravel adjustment mechanism is not intended for a particular style or manufacture of vacuum interrupter or vacuum contactor.

A pivot plate 412 can be provided intermediate the nut 602 and the arm 406 in order to facilitate the opening and closing action of the contactor 100. As can be seen from FIGS. 4 and 5, when the contactor 100 changes from closed to open or from open to closed, the arm 406 rotates through a small arc, contacting the nut 602 and moving the contact 104 to the open position. Although the arm 406 could directly engage the nut 602, lateral forces can be transmitted to the bellows 110 via the corresponding arcuate motion of the moveable contact 104. These lateral forces can reduce the operating life of the bellows 110. The pivot plate 412 and the size of the opening 410 assure that the motion of the moveable contact 108 remains linear even though the arm motion is arcuate thereby substantially reducing the application of any lateral force to the bellows 110.

Figure 4:
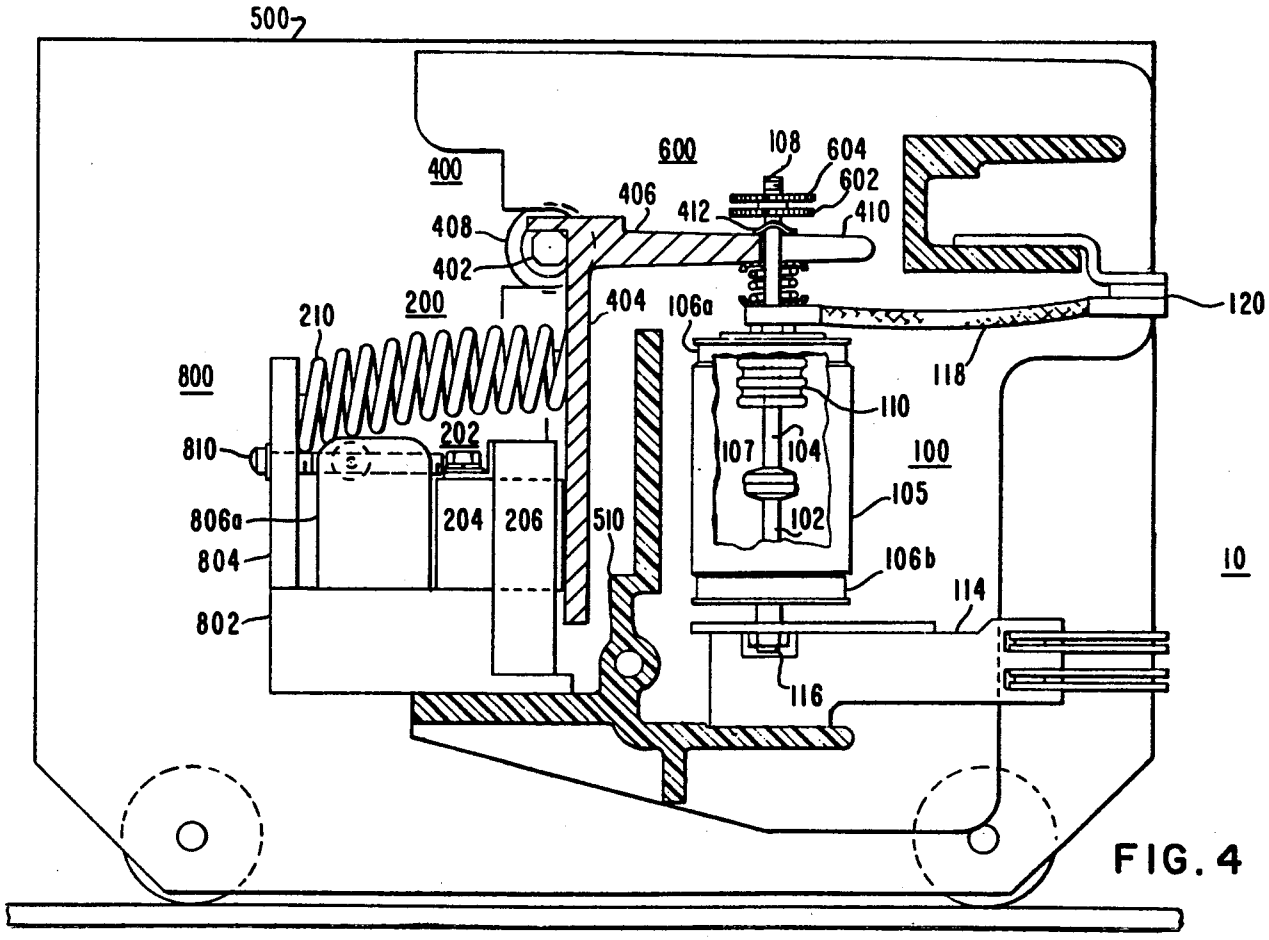
FIG. 4 is a sectional view of the vacuum contactor taken along line IV—IV of FIG. 1 showing the vacuum contactor in the closed position.
Figure 5:
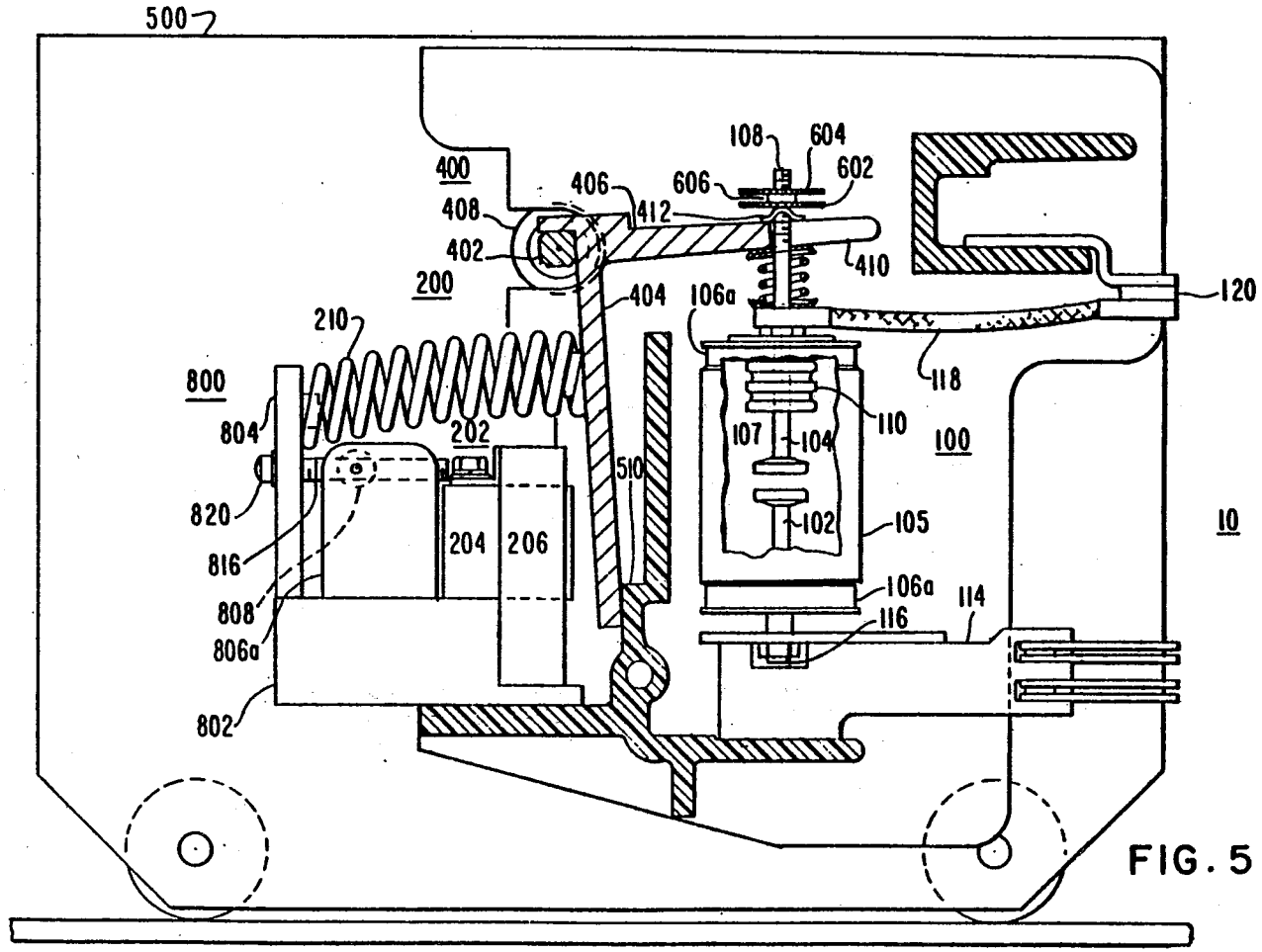
FIG. 5 is a view of the vacuum contactor of FIG. 4 showing the vacuum contactor in the open position.
Figure 6:
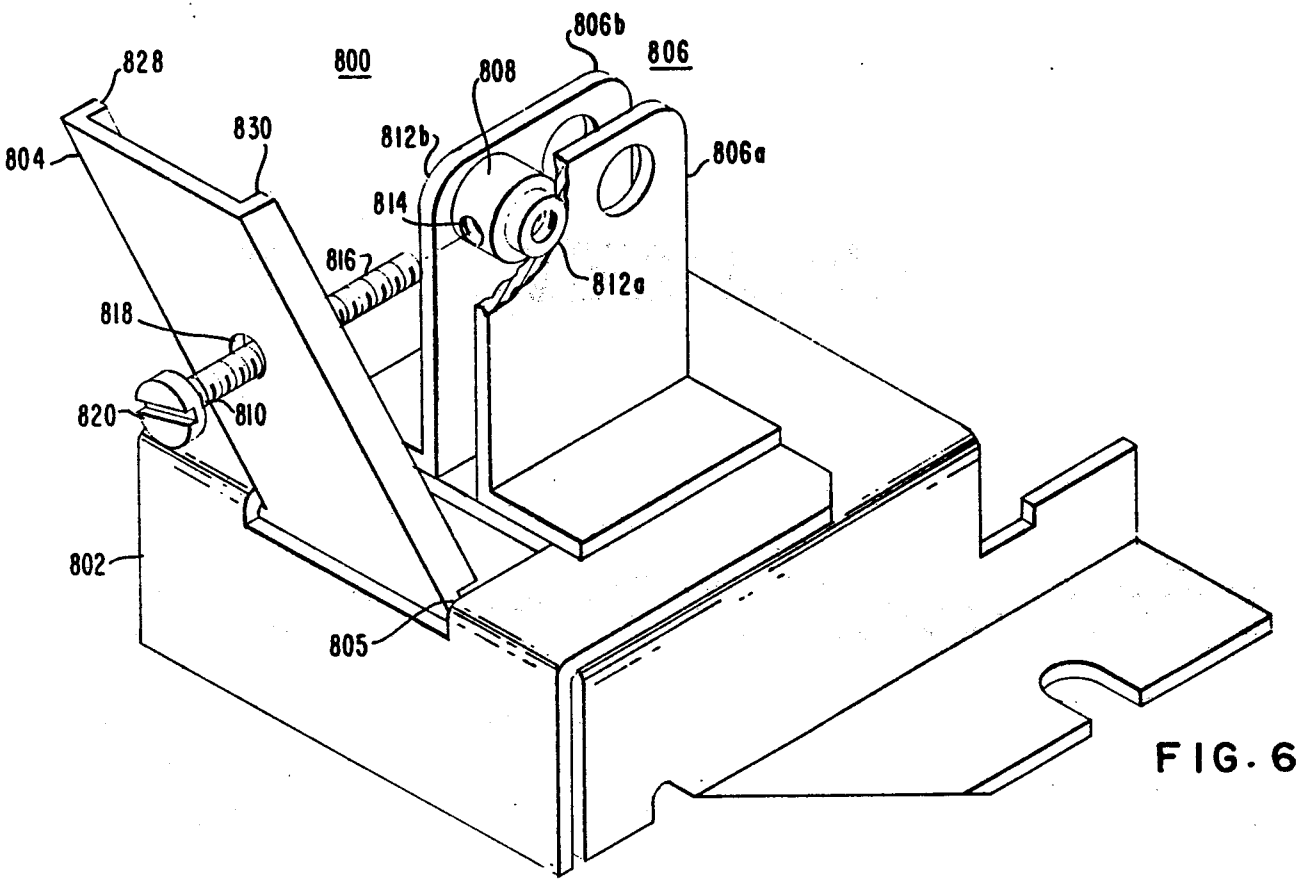
FIG. 6 is an isometric illustration of a spring adjusting mechanism for the vacuum contactor.

Referring to FIGS. 4, 5 and 6, the kickout spring 210 is positioned intermediate the leg 404 and a spring adjusting mechanism 800 including a base 802, a lever 804, a U-shaped bracket 806, a locking block 808, and a rod 810. The lever 804 has one end pivotally mounted to the base 802 with a portion of the lever being in contact with one end of the kickout spring 210. The U-shaped bracket 806 is formed by two L-shaped leg members 806*a* and 806*b* which are secured to the base 802 by fastening means such as self-tapping screws (not shown). Opposed bores 812*a* and 812*b* are provided in the U-shaped bracket 806 for mounting the locking block 808 while allowing for rotation thereof. Bore 814 is provided in the locking block 808 for receiving the shaft 816 of the rod 810. Provided in the lever 804 is a bore 818 corresponding to the bore 814 and through which the shaft 816 of the rod 810 passes. The head 820 of the rod 810 is larger than the opening of the bore 818 in the lever 804, preventing the rod 804 from passing therethrough. A smaller head with a washer can be used to effect the same result. The shaft 816 and the bore 814 can be threaded such that rotation of the rod 810 about the longitudinal axis thereof in one direction causes the lever 804 to increase the force of the kickout spring 210 while rotation of the rod 810 in the opposite direction causes the lever 804 to decrease the force of the kickout spring 210. The length of the kickout spring 210 changes as the force thereof is increased or decreased moving the lever 804 through an arc with respect to the base 802. The bore 818 is dimensioned so that the rod 810 can follow the movement of the lever 804 with the locking block 808 rotating in the opposed bores 812*a* and 812*b* to accommodate the arcuate movement of the rod 810. The spring adjusting mechanism 800 provides for the controllable increase or decrease in the force of the kickout spring 210.

When the electromagnet 202 is energized in response to a control signal generated by a control device such as a pushbutton switch, the magnetic flux created exerts a pull upon the magnetically permeable portion of the leg 404 drawing the leg 404 into contact with the core 204 of the electromagnet 202, compressing the kickout spring 210, and rotating the leg 404 and shaft 402 through an arc. The arm 406 is also rotated in the same direction allowing the atmospheric force upon the bellows 110 to transfer the moveable contact 104 to the closed position (see FIG. 4). An auxiliary spring 130 can be provided intermediate the arm 406 and the chamber 106 to provide additional closing force. Because the amount of contact travel is in the range of 0.1 to 0.2 inches, the amount of rotation of the leg, shaft, and arm is in the range of 3 to 4 degrees.

When the electromagnet 202 is deenergized, the kickout spring 210 acts upon the leg 404 providing sufficient force to overcome any residual magnetic attraction between the leg 404 and the electromagnet 202 rotating the leg 404 and shaft 402 back to their original positions. This in turn rotates the 406 arm lifting the nut 602; thus, transferring the moveable contact 104 to the open position. The opening 410 in the arm 406 is made such that the moveable contact 104 follows a linear path even though, the leg 404, arm 406, and shaft 402 are rotating through arcs. This prevents lateral stresses generated by the rotation of the linkage 400 from being transmitted to the bellows 110. These lateral stresses can decrease the operating life of the bellows leading to the failure of the interrupter. In addition a stop 510 is provided on the housing 500, preferably adjacent the leg 404, to arrest the motion of the linkage 400 caused by kickout spring 210. This prevents overextension of the bellows 110 as the moveable contact 104 returns to the open position when the contactor is deenergized.

I claim:

1. A vacuum contactor, comprising:

vacuum interrupter means for opening and closing an electrical circuit including a moveable contact having a threaded shaft and being transferable between an open position and a closed position;

operating means for effecting relative movement of the moveable contact between the open and closed positions, the operating means including an arm having an opening through which a portion of the threaded shaft of the moveable contact extends;

a housing for supporting the vacuum interrupter means and the operating means;

a first nut; and a second nut, the first nut and second nut each having a threaded bore therethrough and a plurality of radially spaced teeth about the periphery thereof, the first nut and the second nut engaging the portion of the threaded shaft of the moveable contact extending beyond the arm of the operating means with the arm contacting the first nut to hold the moveable contact in the open position and the first nut being spaced from the arm when the moveable contact is in the closed position, the space representing the overtravel gap for the vacuum interrupter means, the second nut contacting the first nut on the threaded shaft whereby the first nut and the second nut so positioned can be removably secured without the transmission of torque to the shaft of the moveable contact by the rotation of the blade of a screwdriver inserted between two teeth of the first nut and two teeth of the second nut, the screwdriver engaging diagonally opposite teeth in the first and second nuts, respectively, during the rotation thereof, the rotation of the blade in one direction tightening the first and second nuts with rotation of the blade in the opposite direction loosening the first and second nuts.

2. The apparatus of claim 1 wherein a spacing washer is interposed with and contacts the first nut and the second nut on the shaft of the moveable contact separating the first nut and the second nut thereby allowing the rotation of the blade of the screwdriver to exert greater force upon the first nut and the second nut.

3. The apparatus of claim 1 wherein the first nut and the second nut have substantially the same diameter with the teeth thereof lying in a plane generally perpendicular to the axis of the threaded bore therein.

4. A vacuum contactor, comprising:

a vacuum interrupter including a stationary contact and a moveable contact enclosed in an evacuated chamber, the moveable contact including a threaded shaft extending out through the chamber via a gas-tight seal, the moveable contact moveable between an open position and a closed position with respect to the stationary contact;

operating means for effecting relative movement of the moveable contact between the open and closed positions, the operating means including an arm having an opening through which a portion of the threaded shaft of the moveable contact extends;

a housing for supporting the vacuum interrupter and the operating means;

a first nut; and a second nut, the first nut and second nut each having a threaded bore therethrough and a plurality of radially spaced teeth about the periphery thereof, the first nut and the second nut engaging the portion of the threaded shaft of the moveable contact extending beyond the arm of the operating means with the arm contacting the first nut to hold the moveable contact in the open position and the first nut being spaced from the arm when the moveable contact is in the closed position, the space representing the overtravel gap of the vacuum interrupter, the second nut contacting the first nut on the threaded shaft whereby the first nut and the second nut so positioned can be removably secured without the transmission of torque to the shaft of moveable contact by the rotation of the blade of a screwdriver inserted between two teeth of the first nut and two teeth of the second nut, the screwdriver engaging diagonally opposite teeth in the first and second nuts, respectively, during the rotation thereof, the rotation of the blade in one direction tightening the first and second nuts with rotation of the blade in the opposite direction loosening the first and second nuts.

5. The apparatus of claim 4 wherein a spacing washer is interposed with and contacts the first nut and the second nut on the shaft of the moveable contact separating the first nut and the second nut thereby allowing the rotation of the blade of the screwdriver to exert greater force upon the first nut and the second nut.

6. The apparatus of claim 4 wherein the first nut and the second nut have substantially the same diameter and the teeth thereof lie in a plane generally perpendicular to the axis of the threaded bore therein.

7. A vacuum contactor, comprising:

a vacuum interrupter including a stationary contact and a moveable contact enclosed in an evacuated chamber, the moveable contact including a threaded shaft extending out through the chamber via a gas-tight seal, the moveable contact moveable between an open position and a closed position with respect to the stationary contact;

operating means for effecting relative movement of the moveable contact between the open and closed positions , the operating means including an arm having an opening through which a portion of the threaded shaft of the moveable contact extends;

a housing for supporting the vacuum interrupter and the operating means;

a first nut;

a spacing washer; and a second nut, the first nut and second nut each having substantially the same diameter, a threaded bore therethrough and a plurality of radially spaced teeth about the periphery thereof lying in a plane that is generally perpendicular to the axis of the bore, the first nut and the second nut engaging the portion of the threaded shaft of the moveable contact extending beyond the arm of the operating means with the spacing washer positioned thereon and interposed with and contacting the first and second nut, the arm contacting the first nut to hold the moveable contact in the open position and the first nut being spaced from the arm when the moveable contact is in the closed position, the space representing the overtravel gap of the vacuum interrupter, whereby the first nut, spacing washer, and the second nut so positioned can be removably secured by the rotation of the blade of a screwdriver inserted into a notch in the first nut and a notch in the second nut, the rotation of the blade in one direction tightening the first and second nuts with rotation of the blade in the opposite direction loosening the first and second nuts, the spacing washer separating the first and second nuts allowing the rotation of the blade of the screwdriver to exert greater force thereon.

8. An apparatus for indicating contact overtravel resulting from contact wear in a vacuum contactor having a vacuum interrupter for opening and closing an electrical circuit, an operating means for opening and closing the vacuum interrupter, a housing for supporting the operating means and the vacuum interrupter, the operating means having a member with an opening therethrough with the vacuum interrupter having a moveable contact with a threaded shaft passing through the opening in the member, comprising:

a first nut; and a second nut, the first nut and second nut each having a threaded bore therethrough and a plurality of radially spaced teeth about the periphery thereof, the first nut and the second nut engaging the portion of the threaded shaft of the moveable contact extending beyond the member of the operating means, the first nut being spaced from the surface of the member when the moveable contact is in the closed position, the space representing the overtravel gap of the vacuum interrupter, the second nut contacting the first nut on the threaded shaft whereby the first nut and the second nut so positioned can be removably secured without transmission of torque to the shaft of the moveable contact by the rotation of the blade of a screwdriver inserted between two teeth in the first nut and two teeth in the second nut, the blade of the screwdriver engaging diagonally opposite teeth in the first and second nuts, respectively, as it is rotated, the rotation of the blade in one direction tightening the first and second nuts with rotation of the blade in the opposite direction loosening the first and second nuts.

9. The apparatus of claim 8 wherein a spacing washer is interposed with and contacts the first nut and the second nut on the shaft of the moveable contact separating the first nut and the second nut thereby allowing the rotation of the blade of the screwdriver to exert greater force upon the first nut and the second nut.

10. The apparatus of claim 9 wherein the first nut and the second nut have substantially the same diameter with the teeth thereof lying in a plane generally perpendicular to the axis of the threaded bore therein.

* * * * *

UNITED STATES PATENT AND TRADEMARK OFFICE

CERTIFICATE OF CORRECTION

PATENT NO. : 4,479,042

DATED : October 23, 1984

INVENTOR(S) : Robert T. Basnett

It is certified that error appears in the above—identified patent and that said Letters Patent is hereby corrected as shown below:

On the title page:

Attorney, Agent or Firm -"JOHN VICTOR PEZDER" should read

-- John Victor Pezdek --.

Signed and Sealed this

*Sixteenth* Day of *April 1985*

[SEAL]

*Attest:*

DONALD J. QUIGG

*Attesting Officer*

*Acting Commissioner of Patents and Trademarks*